US006643378B2

(12) United States Patent
Schumaier

(10) Patent No.: US 6,643,378 B2
(45) Date of Patent: Nov. 4, 2003

(54) BONE CONDUCTION HEARING AID

(76) Inventor: Daniel R. Schumaier, 207 E. Myrtle Ave., Johnson City, TN (US) 37601

( * ) Notice: Subject to any disclaimer, the term of this patent is extended or adjusted under 35 U.S.C. 154(b) by 132 days.

(21) Appl. No.: 09/798,560

(22) Filed: Mar. 2, 2001

(65) Prior Publication Data

US 2002/0122563 A1 Sep. 5, 2002

(51) Int. Cl.[7] ..... H04R 25/00

(52) U.S. Cl. ..... 381/326; 381/328; 381/322; 381/318

(58) Field of Search ..... 381/322, 324, 381/326, 327, 328, 329, 330, 380, 381, FOR 130, FOR 133, FOR 134, 312, 318, 93; 600/25; 607/56, 57

(56) References Cited

U.S. PATENT DOCUMENTS

| | | | | |
|---|---|---|---|---|
| 3,594,514 A | | 7/1971 | Wingrove | |
| 3,688,863 A | | 9/1972 | Johnson | |
| 3,764,748 A | * | 10/1973 | Branch et al. | 381/326 |
| 4,612,915 A | | 9/1986 | Hough et al. | |
| 5,015,225 A | | 5/1991 | Hough et al. | |
| 5,047,994 A | | 9/1991 | Lenhardt et al. | |
| 5,091,952 A | * | 2/1992 | Williamson et al. | 381/318 |
| 5,447,489 A | | 9/1995 | Issalene et al. | |
| 5,606,621 A | * | 2/1997 | Reiter et al. | 381/328 |
| 5,701,348 A | * | 12/1997 | Shennib et al. | 381/328 |
| 5,857,958 A | | 1/1999 | Ball et al. | |
| 5,935,166 A | | 8/1999 | Kennedy | |
| 6,010,532 A | | 1/2000 | Kroll et al. | |
| 6,041,129 A | | 3/2000 | Adelman | |
| 6,137,889 A | * | 10/2000 | Shennib et al. | 381/328 |

FOREIGN PATENT DOCUMENTS

| | | | | |
|---|---|---|---|---|
| JP | 58065689 | | 10/1984 | |
| JP | 362151100 | * | 7/1987 | 381/FOR 134 |

OTHER PUBLICATIONS

Affidavit of Larry Hatfield including photos.

* cited by examiner

*Primary Examiner*—Huyen Lee
(74) *Attorney, Agent, or Firm*—Luedeka, Neely & Graham, P.C.

(57) ABSTRACT

A bone conduction hearing aid includes a vibrator carried by the insertion end of the hearing aid. When the hearing aid is inserted into the ear canal of a patient, the vibrator is positioned in the ear canal adjacent the mastoid bone. A microphone receives sound waves and outputs a microphone signal to the hearing aid electronics where the microphone signal is amplified and then sent to the vibrator, causing the vibrator to vibrate. Vibrations produced by the vibrator are transferred to the opposite cochlea by way of the mastoid bone, enabling enhanced hearing perception in patients with hearing loss in one ear. Transfer of vibrations to the bones of the middle ear also assists patients with conductive pathology in one ear. The hearing aid may also function to enhance communication in high noise environments. Feedback from the vibrator to the microphone is eliminated electronically. Various alternate forms of feedback elimination are also contemplated by the invention.

22 Claims, 4 Drawing Sheets

BONE CONDUCTION HEARING AID

BACKGROUND

1. Field of the Invention

The present invention relates generally to devices for assisting the hearing impaired. More particularly, the present invention relates to a bone conduction hearing aid having a vibrator which is placed in the ear.

2. Background of the Invention

Transcranial cross amplification has been used for patients that have a profound sensorineural (permanent) hearing loss in one ear and normal hearing or a mild hearing loss in the other ear. A typical remedial approach used by practitioners has been to employ powerful acoustic speakers which produce an amplified sound so intense to the bad ear that the sound is transferred through bone conduction in the skull to the cochlea of the good ear. The purpose of this approach is to increase hearing sensitivity when the primary signal is coming from the side of the bad ear and also to improve a patient's signal to noise ratio for speech, especially in situations where noise is being introduced to the good ear. Unfortunately, the acoustic speakers provide a poor transfer of sound when used in a transcranial application (i.e., when the amplified sound output by the speakers is to be used to stimulate the bony portion of the ear canal for transfer through the skull to the good cochlea). Because of the power required, feedback often occurs before an optimal intensity level can be achieved for stimulating the bony portion of the ear canal. Thus, the gain of the instrument must be reduced, which in turn reduces the effectiveness of the hearing aid.

Another remedial approach used by practitioners has been to employ a body type hearing aid with a bone vibrator. Such bone vibrators are normally worn on the mastoid bone behind the ear and are generally used for individuals with conductive losses (outer or middle ear pathology). The bone vibrator used with body hearing aids are typically held in place with a head band that provides a sufficient force to maintain good contact with the mastoid bone. Disadvantages of such hearing aids are that they are aesthetically undesirable and physically uncomfortable.

Therefore, there is a need for an improved bone conduction hearing aid. The hearing aid may be used to improve hearing in ears with conductive pathology.

SUMMARY OF THE INVENTION

The present invention eliminates the difficulties and disadvantages of the prior art by providing a hearing aid that enhances a user's hearing perception. The hearing aid includes an acoustic vibration sensor for sensing acoustic vibrations and producing an acoustic vibration signal corresponding to the sensed acoustic vibrations. The acoustic vibration signal is amplified by electronics to produce an amplified acoustic vibration signal. A power source supplies electrical power to the electronics. A vibrator is positioned in the user's, or patient's ear canal adjacent the mastoid bone. The vibrator receives the amplified acoustic vibration signal and produces vibrations which are transmitted to the mastoid bone. Vibrations transmitted to the mastoid bone are transferred transcranial to the opposite cochlea to enhance the user's hearing perception. Vibrations transmitted to the mastoid bone may also be transferred to the cochlea of an ear with conductive loss to enhance the user's hearing perception.

Vibration produced by the vibrator may result in undesired feedback to the acoustic vibration sensor. To eliminate such feedback, a feedback reduction circuit is included with the electronics. A user interface may be provided to enable user control of feedback circuit parameters. In an alternate form of feedback reduction/elimination, the acoustic vibration sensor is vibrationally isolated from the vibrator so that vibration produced by the vibrator is not sensed by the acoustic vibration sensor. For example, a vibration attenuating material separates the vibrator and acoustic vibration sensor.

The present invention also provides a method for improving hearing perception in a patient. In accordance with a preferred method, acoustic vibrations are sensed and a corresponding acoustic vibration signal is produced. The acoustic vibration signal is amplified to produce an amplified acoustic vibration signal. A vibrator is positioned in the patient's ear canal adjacent the mastoid bone. The vibrator is then vibrated with the amplified acoustic vibration signal.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
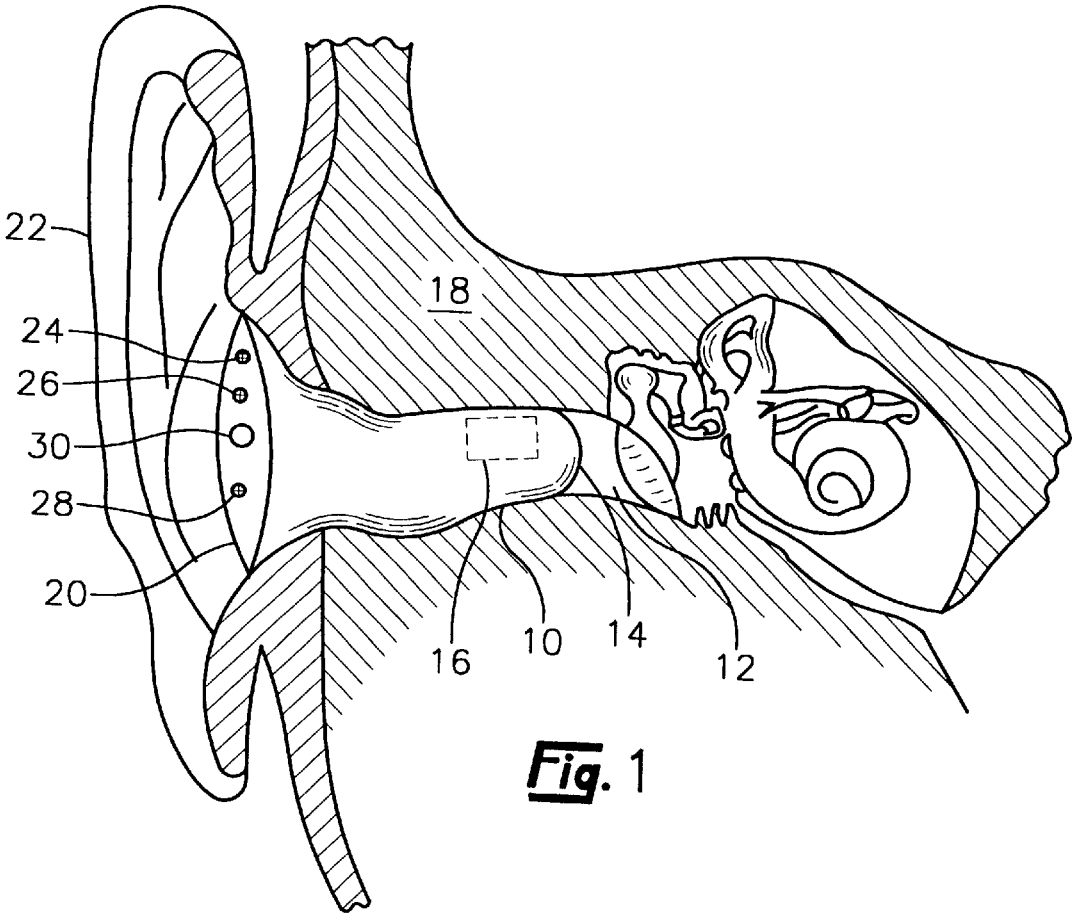
FIG. 1 is a sectional view of a patient with a hearing aid according to the present invention inserted into the patient's ear.

With reference now to the drawings in which like reference characters designate like or similar parts throughout the several views, FIG. 1 illustrates an in-the-ear bone conduction hearing aid 10 in accordance with the invention. The hearing aid 10 is preferably custom formed to closely fit the ear canal of the patient, and FIG. 1 shows the hearing aid 10 fully inserted in the patient's ear canal 12. The hearing aid 10 includes an insertion end 14 which is inserted first into the ear canal 12. A vibrator 16 is carried by that portion of the hearing aid 10 which is positioned in the ear canal 12. Thus, when the hearing aid is inserted in the ear canal 12, the vibrator 16 is positioned in the ear canal 12 adjacent the mastoid bone 18 (also referred to in the art as the temporal bone). In use, the other end 20 of the hearing aid 10 is positioned adjacent the outer ear 22. External features shown in FIG. 1 at end 20 include an acoustic vibration sensor, or microphone 24 for receiving acoustic vibration and a volume control 26 for controlling the level of amplification provided by the hearing aid 10. Access to the hearing aid battery 30 is also provided at end 20.

In a preferred embodiment, the vibrator 16 is carried within the hearing aid 10 as shown in FIG. 1. Therefore, the body portion of the hearing aid 10 is preferably formed from a material suitable for transferring vibration produced by the vibrator 16 to the mastoid bone 18. Suitable materials include hard plastic and polycarbonate. Suitable vibrators 16 include those of the "moving coil" type having a size sufficiently small to fit within the ear canal. A piezoelectric vibrator may also be employed in accordance with the invention.

Figure 2:
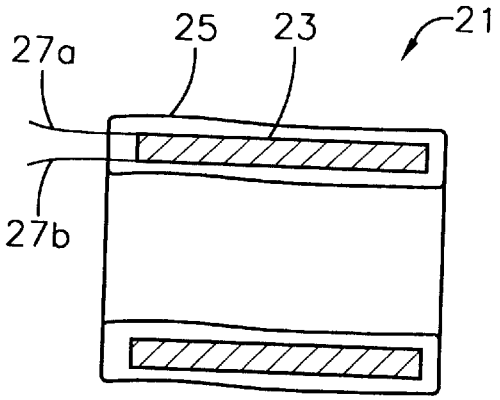
FIG. 2 is a cross-sectional side view of a piezoelectric vibrator that may be employed in a hearing aid according to the present invention.
Figure 3:
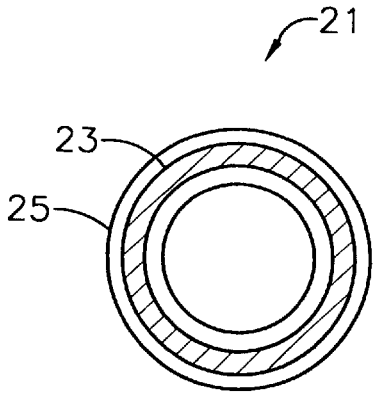
FIG. 3 is a cross-sectional end view of a piezoelectric vibrator that may be employed in a hearing aid according to the present invention.

FIGS. 2 and 3 show an exemplary configuration of a piezoelectric vibrator 21 that may be employed in the practice of the invention, it being understood that other configurations may be employed as well. The piezoelectric vibrator 21 shown in FIGS. 2 and 3 is of cylindrical dimension having a cylindrically shaped piezoelectric ceramic 23 encapsulated within a shell 25. In a preferred embodiment, the piezoelectric vibrator 21 has a diameter of about 3/16 inches and a length of about ½ inch. The piezoelectric vibrator 21 is constructed to expand radially when electrical excitation is applied across the electrodes 27*a*, 27*b*.

Referring again to FIG. 1, vibration produced by the vibrator 16 may be transferred through the hearing aid 10 and picked up by the microphone 24, producing undesirable feedback particularly at higher amplifications. If electronic feedback reduction is desired, a feedback reduction control 28 is provided at end 20 to enable user adjustment of feedback control circuitry within the hearing aid 10.

In operation, sound waves are received by the microphone 24 and the microphone 24 outputs a corresponding microphone signal. The microphone signal is amplified and the amplified microphone signal is provided to the vibrator 16. Vibrations produced by the vibrator 16 are imparted to the mastoid bone 18, which in turn transfers the vibration to the other ear by way of transcranial transfer. The transferred vibrations are perceived by the other cochlea. Thus, sound perception in patients with hearing loss in one ear is improved. Placing the vibrator 16 in the ear canal in close proximity to the mastoid bone 18 provides excellent transfer of vibration to the better ear by way of the mastoid bone 18. Placing the vibrator 16 in the ear canal provides the additional advantage of making the hearing aid 10 less conspicuous, which enhances the hearing aid's aesthetics.

The hearing aid 10 can also function to improve hearing in the same ear in which the hearing aid 10 is inserted. For example, patients with conductive pathology in one ear can experience improved hearing perception by placing the hearing aid 10 in the ear with the conductive loss. Vibrations produced by the vibrator 16 are transferred by way of the mastoid bone 18 to the cochlea of the affected ear.

The hearing aid 10 can even be used to improve hearing perception in individuals with no hearing loss in either ear. In extremely noisy environments the hearing aid 10 can function both as a plug and as a filter which electronically filters the noise while allowing desired sound to be perceived. For example, aircraft maintenance personnel are commonly required to work in close proximity to aircraft while the engines are turning. Good communication among the maintenance crew is essential from a safety standpoint as well as to ensure the aircraft is in proper working condition. A hearing aid in accordance with the invention would be particularly useful in this type of noisy environment since it would block aircraft noise by acting as a plug, electronically filter the engines' higher frequency noise components, and still allow the lower frequency human voice to be sensed and perceived by the user.

Figure 4:
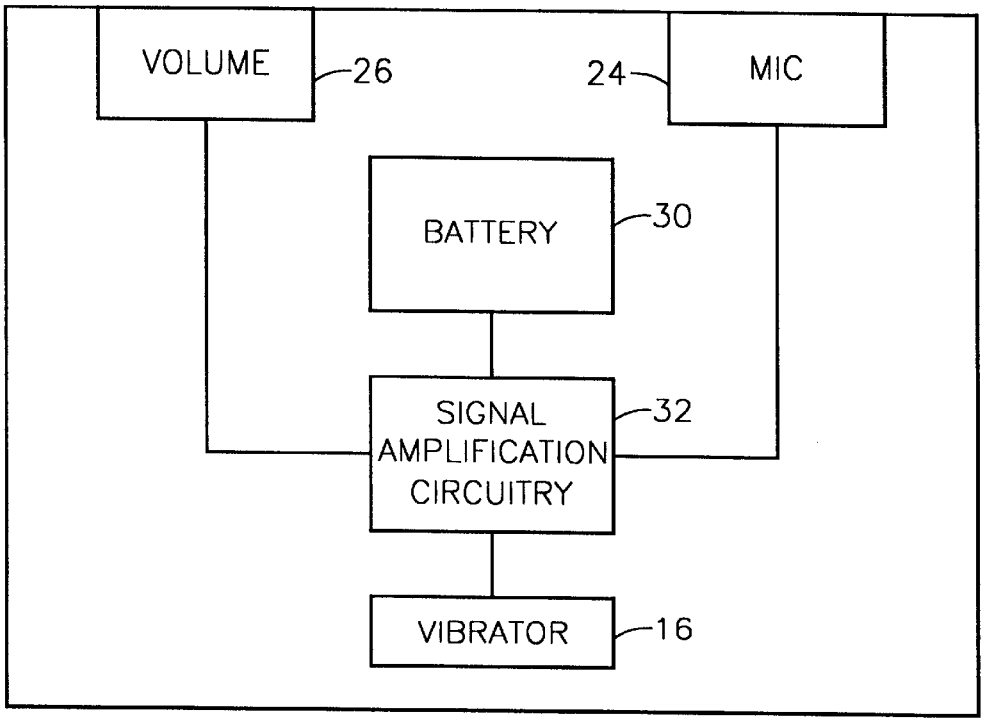
FIG. 4 is a functional block diagram of a hearing aid according to the invention.

A functional block diagram of a hearing aid 10 according to the invention is shown in FIG. 4. Sound waves are received by the microphone 24 which outputs a microphone signal to the signal amplification circuitry 32. The microphone signal is amplified by an amplifier within the signal amplification circuitry 32 and the amplified signal is sent to the vibrator 16 which produces vibrations corresponding to the amplified microphone signal. Electrical power is provided by a battery 30. The level of amplification can be adjusted with the volume control 26.

Figure 5:
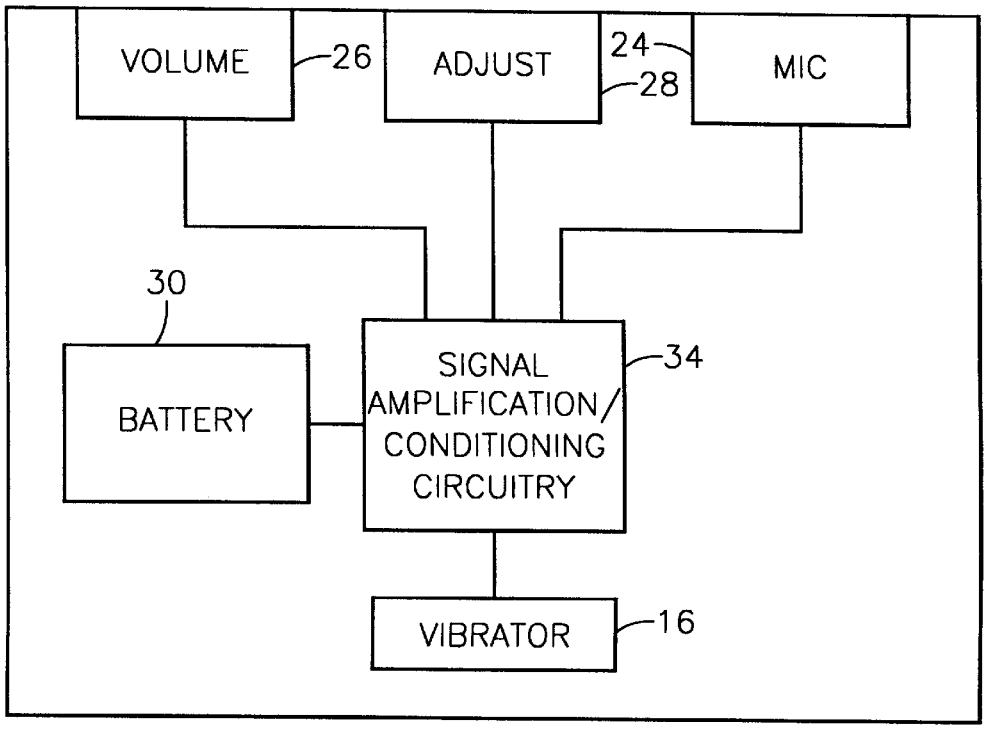
FIG. 5 is a functional block diagram of a hearing aid according to the invention with feedback elimination circuitry.

FIG. 5 shows a functional block diagram of a further embodiment of a hearing aid 10 with electronic feedback control according to the invention. In addition to the microphone 24, vibrator 16, battery 30, and volume control 26 discussed above, the embodiment of FIG. 5 includes signal amplification/conditioning circuitry 34 which performs the dual function of amplifying the microphone signal and reducing feedback in the microphone signal that may result when vibration produced by the vibrator 16 is sensed by the microphone 24. In a preferred embodiment, feedback is reduced by including a notch filter in the signal amplification/conditioning circuitry 34. The notch filter limits the frequency range of the microphone output by removing from the microphone signal frequencies at which feedback occurs, such frequencies typically being in the higher frequency ranges above normal human speech. Thus, use of a notch filter in this manner has the advantage of reducing or eliminating feedback without adversely the patient's ability to perceive normal human speech. The filter parameters may be preset when the hearing aid 10 is manufactured so that no adjustments are needed during use. Alternatively, a feedback adjustment control 28 may be provided to enable user control of feedback reduction.

Figure 6:
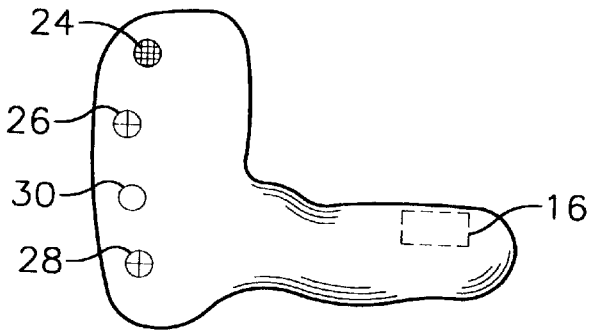
FIG. 6 is a side view of an in-the-ear hearing aid embodiment according to the invention.

A bone conduction hearing aid 10 in accordance with the invention can be provided in a wide variety of hearing aid types. The hearing aid 10 of FIG. 1 is generally referred to as a "canal" type hearing aid. FIG. 6 shows an "in-the-ear" or "ITE" hearing aid according to the invention which includes a microphone 24, volume control 26, battery 30, vibrator 16, and if desired, feedback adjustment control 28.

Figure 7:
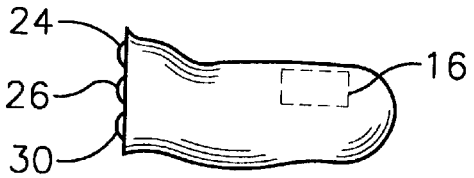
FIG. 7 is a side view of a completely in-the-canal hearing aid embodiment according to the invention.

FIG. 7 shows a hearing aid type commonly referred to as a "completely in-the-canal" or "CIC" hearing aid. External features such as the microphone 24, volume control 26, and battery 30 are less accessible by the user when this type of hearing aid is being worn. However, this hearing aid provides a level of discreteness not available with other hearing aid types.

Figure 8:
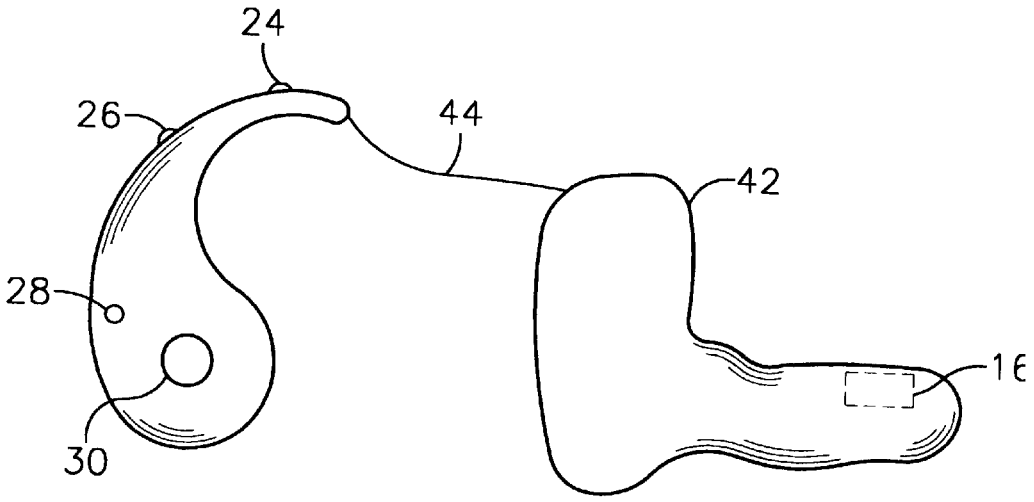
FIG. 8 is a side view of a behind-the-ear hearing aid according to the invention.

FIG. 8 shows a hearing aid type commonly referred to as a "behind-the-ear" or "BTE" hearing aid. This hearing aid type is characterized by an element 40 which is configured to be supported by the outer ear of the patient. Element 40 preferably includes the microphone 24, volume control 26, battery 30, and feedback adjustment control 28 (if desired). Element 40 is tethered to element 42, which is the portion of the hearing aid that is inserted into the ear canal and contains the vibrator 16. The two elements 40, 42 communicate with one another via an electrical wire 44. Alternatively, the two elements 40, 42 are configured for wireless communication with one another.

Figure 9:
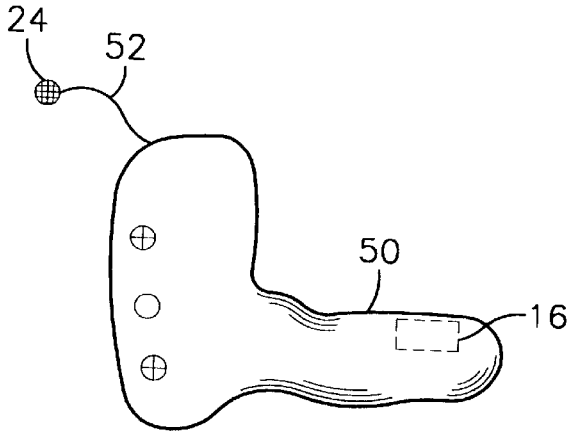
FIG. 9 is a side view of a hearing aid with tethered microphone for eliminating feedback according to the invention.
Figure 10:
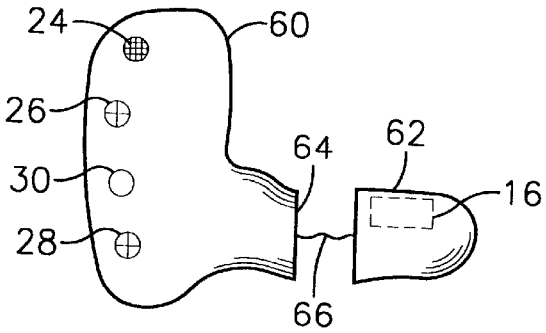
FIG. 10 is a side view of a two-piece hearing aid which eliminates feedback in accordance with the invention.
Figure 11:
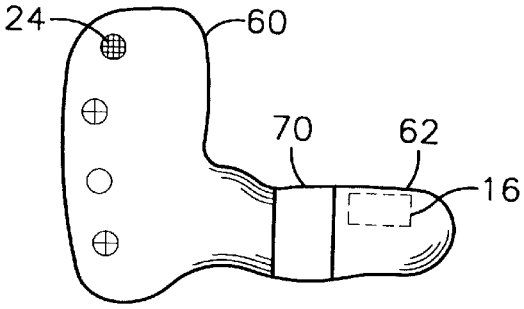
FIG. 11 is a side view of a three-piece hearing aid which eliminates feedback in accordance with the invention.

Applicant has hereinabove described a preferred method and apparatus for eliminating vibrator feedback to the microphone 24. FIGS. 9–11 illustrate alternate ways of eliminating feedback. In FIG. 9, feedback from the vibrator 16 to the microphone 24 is eliminated by positioning the microphone 24 remotely from the hearing aid structure 50 which carries the vibrator 16. The microphone 24 is tethered to the hearing aid 50 by an electrical wire 52 or other conduit which carries the microphone output to the hearing aid 50.

In FIG. 10, feedback is eliminated by mounting the microphone 24 on an outer structure 60 which is separate from an inner structure 62 on which the vibrator 16 is mounted. The outer structure 60 also preferably carries a volume control 26, battery 30, and feedback adjustment control 28 (if desired). The inner structure 62 is placed deep within the ear canal, and the outer structure 60 includes one end 64 which is inserted into that portion of the outer ear approaching the ear canal (and possibly extending a short distance into the ear canal) so as to hold the structure 60 in place. A wire 66 or other conduit enables communication between the two structures 60, 62.

The hearing aid shown in FIG. 11 is similar to that shown in FIG. 10. That is, feedback is eliminated in the hearing aid of FIG. 11 by mounting the microphone 24 on an outer structure 60 and mounting the vibrator 16 on a separate inner structure 62 with the two structures 60, 62 being in electrical communication with one another. The two structures are then structurally interconnected with a vibration attenuating material 70, such as rubber, which is different than the material from which inner structure 62 is fabricated. The vibration attenuating material 70 inhibits vibration produced by the vibrator 16 from reaching the microphone 24, thereby eliminating feedback.

While the invention has been described in detail, it is to be expressly understood that it will be apparent to persons skilled in the relevant art that various changes of form, design or arrangement may be made to the invention without departing from the spirit and scope of the: invention. For example, in lieu of the feedback elimination configuration shown in FIG. 11, the microphone 24 may be set or potted in a vibration attenuating material to prevent vibrations produced by the vibrator 16 and transmitted through the body portion of the hearing aid from being sensed by the microphone 24. Therefore, the above mentioned description is to be considered exemplary, rather than limiting, and the true scope of the invention is that defined in the following claims.

What is claimed is:

1. A hearing assistance device for enhancing hearing perception in a user, the device comprising:

an acoustic vibration sensor for sensing acoustic vibrations and producing an acoustic vibration signal corresponding to the sensed acoustic vibrations;

electronics for receiving and amplifying the acoustic vibration signal to produce an amplified acoustic vibration signal;

a power source for supplying electrical power to the electronics; and a non-surgically implanted, nonacoustic vibrator inserted into a user's ear canal adjacent the mastoid bone, said nonacoustic vibrator receiving the amplified acoustic vibration signal and directly producing vibrations which are transferred by the mastoid bone to a cochlea of the user.

2. The hearing assistance device of claim 1, further comprising a volume control interface electrically connected to said electronics for controlling amplification of the acoustic vibration signal.

3. The hearing assistance device of claim 1 wherein said electronics include feedback reduction circuitry for reducing feedback from the vibrator to the acoustic vibration sensor.

4. The hearing assistance device of claim 3 wherein said feedback reduction circuitry includes a filter for limiting the frequency range of the acoustic vibration signal.

5. The hearing assistance device of claim 3, further comprising a feedback control interface electrically connected to said electronics for controlling feedback reduction.

6. The hearing assistance device of claim 1, further comprising a first structural member having a first end with a generally cylindrical shape for being inserted into the user's ear canal and a second end in opposed relation to the first end, said vibrator being attached to the first structural member.

7. The hearing assistance device of claim 6 wherein said acoustic vibration sensor and power source are positioned adjacent the second end of the first structural member.

8. The hearing assistance device of claim 6 wherein said power source and electronics are attached to said first structural member and said acoustic vibration sensor is tethered to said first structural member.

9. The hearing assistance device of claim 6, further comprising a second structural member electrically connected to the vibrator of the first structural member, said acoustic vibration sensor being attached to the second structural member.

10. The hearing assistance device of claim 9, further comprising a third structural member interconnecting the first and second structural members, said third structural member being formed from a vibration attenuating material which is different than the material forming the first structural member.

11. The hearing assistance device of claim 10 wherein said vibration attenuating material is rubber.

12. A hearing aid for improving hearing perception in a hearing impaired patient, the hearing aid comprising:

a structural member fabricated for insertion into the patient's ear canal, said structural member having a first end in opposed relation to a second end;

a non-surgically implanted, nonacoustic vibrator carried by said structural member and operable to directly produce vibrations which are transferred by the mastoid bone to a cochlea of the user, said nonacoustic vibrator being positioned in the ear canal adjacent the mastoid bone when the first end of the structural member is inserted into the ear canal;

a microphone attached to the structural member adjacent the second end for receiving acoustic vibrations and producing a microphone signal corresponding to the sensed acoustic vibrations;

electronics carried by said structural member for receiving and amplifying the microphone signal to produce an amplified microphone signal that is received by the vibrator, said electronics including feedback reduction circuitry for reducing feedback from the nonacoustic vibrator to the microphone; and a power supply for supplying electrical power to the electronics.

13. The hearing aid of claim 12, further comprising a volume control interface electrically connected to said electronics for controlling amplification of the microphone signal.

14. The hearing aid of claim 12, further comprising a feedback control interface electrically connected to said electronics for controlling feedback reduction.

15. The hearing aid of claim 12 wherein said feedback reduction circuitry includes a filter for limiting the frequency range of the microphone signal.

16. A hearing aid for improving hearing perception in a hearing impaired patient, the hearing aid comprising:

a structural member fabricated for insertion into the patient's ear canal, said structural member having a first end in opposed relation to a second end;

a non-surgically implanted, nonacoustic vibrator carried by said structural member and operable to directly produce vibrations which are transferred by the mastoid bone to a cochlea of the user, said nonacoustic vibrator being positioned in the ear canal adjacent the mastoid bone when the first end of the structural member is inserted into the ear canal;

a microphone attached to the structural member adjacent the second end for receiving acoustic vibrations and producing a microphone signal corresponding to the sensed acoustic vibrations, said microphone being vibrationally isolated from the nonacoustic vibrator to inhibit vibration feedback in the microphone signal;

electronics carried by said structural member for receiving and amplifying the microphone signal to produce an amplified microphone signal that is received by the vibrator; and a power supply for supplying electrical power to the electronics.

17. The hearing aid of claim 16 wherein said structural member further includes a vibration attenuating material for vibrationally isolating the vibrator and the microphone.

18. A method for improving hearing perception in a patient, the method comprising:

sensing acoustic vibrations with an acoustic vibration sensor;

producing an acoustic vibration signal corresponding to the sensed acoustic vibrations;

amplifying the acoustic vibration signal to produce an amplified acoustic vibration signal;

inserting a non-surgically implanted, nonacoustic vibrator in the patient's ear canal adjacent the mastoid bone, said nonacoustic vibrator being operable to directly produce vibrations which are transferred by the mastoid bone to a cochlea of the patient; and vibrating the nonacoustic vibrator with the amplified acoustic vibration signal.

19. The method of claim 18, further comprising varying the level of amplification of the acoustic vibration signal.

20. The method of claim 18, further comprising removing noise from the acoustic vibration signal caused by vibrations produced by the vibrator.

21. The method of claim 20 wherein said step of removing noise further comprises limiting the frequency range of the acoustic vibration signal.

22. The method of claim 18, further comprising isolating the vibrator from the acoustic vibration sensor to inhibit vibration feedback in the acoustic vibration signal.

* * * * *